US006358187B1

(12) United States Patent
Smith

(10) Patent No.: US 6,358,187 B1
(45) Date of Patent: Mar. 19, 2002

(54) APPARATUS FOR MONITORING AND DISPLAYING EXERTION DATA

(76) Inventor: Carl M. Smith, 1316 Bishop La., Alexandria, VA (US) 22302

( * ) Notice: Subject to any disclaimer, the term of this patent is extended or adjusted under 35 U.S.C. 154(b) by 0 days.

(21) Appl. No.: 09/314,026

(22) Filed: May 19, 1999

(51) Int. Cl.[7] ..... A61M 25/00
(52) U.S. Cl. ..... 482/4; 600/595
(58) Field of Search ..... 600/587, 595; 601/23, 33, 40; 482/1–9, 900–902

(56) References Cited

U.S. PATENT DOCUMENTS

| | | | | |
|---|---|---|---|---|
| 5,763,284 A | | 8/1988 | Carlin | |
| 5,258,927 A | * | 11/1993 | Havriluk et al. | 482/111 |
| 5,605,336 A | | 2/1997 | Gaoiran et al. | |
| 5,723,786 A | | 3/1998 | Klapman | |
| 6,063,045 A | * | 5/2000 | Wax et al. | 600/591 |

* cited by examiner

*Primary Examiner*—Glenn E. Richman
(74) *Attorney, Agent, or Firm*—IP Strategies, P.C.

(57) ABSTRACT

An apparatus for monitoring and displaying information related to pressure exerted at a point of interest during an isometric exercise includes a fabric base, adapted to receive a body part. A sensor is attached to the fabric base and disposed at the point of interest during the isometric exercise, and measures a pressure magnitude at the point of interest and provides a pressure signal corresponding to the pressure magnitude. A monitor, which receives the pressure signal, processes the pressure signal to derive information that is meaningful to a user, and generates a display signal corresponding to the information derived from the pressure signal. A display device, attached to the fabric base, receives the display signal and provides a visual indication of the information to the user. The fabric base includes an opening for receiving a thumb. The sensor is attached to the fabric base on a first side of the opening, and the display device is attached to the fabric base on a second side of the opening.

42 Claims, 4 Drawing Sheets

APPARATUS FOR MONITORING AND DISPLAYING EXERTION DATA

FIELD OF THE INVENTION

The present invention relates in general to resistance exercise systems. In particular, the present invention relates to a device that monitors the effort of a person performing a resistance exercise and provides feedback on that person's performance.

BACKGROUND OF THE INVENTION

Physical fitness is a growing concern among people around the world. As a result, activities involving all forms of exercise have become increasingly popular. While many people limit their activities to cardiovascular-type exercises, others have discovered the many benefits of resistance training. Resistance training belongs to the category of exercise systems in which the muscles are worked to partial or total failure against an opposing force, usually gravity or a spring force of some type. Through proper nutrition and rest, the muscles recover such that they are stronger than before the failure was induced. Resistance training in general has been shown to increase lean muscle mass, strengthen joints, improve posture, and raise metabolic levels. It is generally believed that maximum health benefits can be obtained by following an exercise program including a combination of cardiovascular and resistance training. Thus, resistance training should form at least a component of a person's exercise regimen.

Traditionally, people have gone to gyms having weight rooms in order to perform resistance training. These weight rooms are typically equipped with free weights and resistance training machines, such as Nautilus® equipment. Membership fees to these gyms can be expensive, however. Further, memberships are frequently oversold, resulting in long waits to use equipment. Many people will not tolerate the inconvenience of working out in a gym, while others are intimidated at the idea of working out in the company of strangers.

The inconvenience and expense of exercising in a gym has led to the proliferation of products designed to provide resistance training capability in the home. These products range from large machines, such as universal gym machines, to smaller devices that can be stored in a closet. A universal gym may provide the capability to effectively train every major muscle group, but it is a large device that requires substantial space dedicated for its use. On the other hand, the smaller devices (such as hand grips) generally do not provide an effective, complete workout, as they tend to concentrate on only a single muscle group. In any case, these devices usually must be used at home or in another location; spontaneous use of these devices in public settings is often not practical.

Isometric exercises, however, may be performed virtually anywhere, anytime. Isometric exercises refer generally to resistance training of the muscles by tension, usually provided by working the muscles in opposition to each other or against a substantially immovable object. For example, resistance training of the biceps muscles may be provided by pressing the palms of the hands upward against the underside of a desktop. Likewise, resistance training of the shoulders and chest may be provided by pressing the palms of the hands together and increasing the opposing pressure.

Thus, isometric exercises may be performed at home, in the office, or even while riding public transportation. At home, a person may use opposing muscle groups to provide the necessary tension for a particular exercise. Alternatively, the person may use an object such as a doorway as a base against which to push in order to isometrically exert his muscles. In the office, a desk may be used inconspicuously as a base, or a person may exert opposing muscles against each other while reading or doing other work. Similarly, these exercises may be performed while in a taxi or airplane, or while riding a bus or subway. The flexibility and convenience provided by the very nature of isometric exercises makes it more likely that a person will stick to an exercise plan.

Isometric exercise also allows resistance training to be performed in environments in which other forms of resistance training are impossible. For example, it is entirely impractical to provide resistance training equipment to astronauts stationed in space. Payload restrictions imposed on such missions simply do not allow the stowing of heavy equipment that is not critical to the purpose of the mission. However, isometric exercises may be performed without the use of such equipment, and may be performed without leaving a particular workstation or while complying with other physical restrictions. Isometric exercise is therefore well suited for use by those involved in the space program.

Currently, isometric exercises provide an effective resistance training workout, but provide no indication of the level of work being performed or of the progress made by the person performing the exercises. That is, conventional isometric exercises provide no quantitative measure of the effort exerted by the exerciser. This makes it impossible for the exerciser to set performance goals or to track improvement. Many people require such quantitative data in order to remain motivated to continue with an exercise program.

SUMMARY OF THE INVENTION

It is therefore an objective of the present invention to provide a device that monitors certain performance characteristics of a person performing an isometric exercise.

It is a further objective of the present invention to provide a device that provides a quantitative indication of the performance level of an isometric exercise.

It is an additional objective of the present invention to provide a device that indicates to a user when a specific performance goal has been reached when performing an isometric exercise.

It is another objective of the present invention to provide a device that stores quantitative data corresponding to previous isometric exercise performance achievements.

The present invention is an apparatus for monitoring and displaying exertion data. The apparatus includes a sensor that measures a pressure change at the sensor and provides a pressure signal corresponding to a magnitude of the pressure change, a monitor device that receives the pressure signal and processes the pressure signal according to processing instructions and generates a display signal, and a display device that receives the display signal and provides visual information corresponding to the display signal. Preferably, the sensor includes a transducer against which incident pressure is applied and which generates a voltage level proportionate to a magnitude of the incident pressure, and a converter that receives the voltage level and converts the voltage level to the pressure signal. The pressure signal is preferably a digital signal. The monitor device preferably includes a processor that receives the pressure signal, processes the pressure signal, and generates pressure data and the display signal, and program memory, in which the processing instructions are stored and which provides the processing instructions to the processor to control processing of the pressure signal. The monitor device may further include data memory, for storing the pressure data. The pressure data may include data corresponding to an instantaneous pressure change at the sensor, or data corresponding to a peak pressure incident at the sensor. The monitor preferably further includes a clock generator for providing a periodic output signal, in which case the pressure data may include data corresponding to a duration of incident pressure at the sensor, data corresponding to a duration that incident pressure at the sensor is maintained above a threshold pressure, or data corresponding to a number of repetitions that incident pressure at the sensor crosses a threshold pressure in a positive direction, measured by the output signal of the clock generator. The monitor device may further include an audio output device, which provides an audible signal on actuation by the processor under the control of the processing instructions, when predetermined pressure data is generated. In this case, the pressure data may include a comparison result of first pressure data corresponding to a current pressure signal and second pressure data stored in the data memory; and the audio output device would provide an audible signal on actuation by the processor under the control of the processing instructions, when predetermined pressure data is generated. The monitor device preferably includes a switch which, when actuated, forces the processing instructions to a certain value. The switch may be coupled to an address input of the program memory, and actuation of the switch changes a program address of the program memory to a set value, causing interruption of processing of the pressure signal. Further, actuation of the switch may change a program address of the program memory to a set value, causing a change in the display signal. The display device preferably includes display elements to provide a visual indication of the display signal.

According to a preferred embodiment of the present invention, the apparatus also includes a fabric base, wherein the sensor, the monitor device, and the display device are attached to the fabric base. The fabric base may be formed in the shape of a glove that is adapted to receive a hand, or may simply be formed in the shape of a loop that is adapted to wrap around any body part, and which includes a fastener to secure the fabric base when the fabric base is wrapped around the body part. The fabric base may include an opening for receiving a thumb, and an elastic periphery adapted to provide a spring force such that the fabric base can grip a user's hand. The sensor is preferably disposed within a region of the fabric base such that, when the fabric base is wrapped around a hand and a thumb of the hand is placed through the opening, the sensor is located proximate to the palm of the hand and the display device is located on the back portion of the hand, mounted on the monitor device. The sensor may be coupled to the monitor device by an electrically conductive wire that is disposed within the fabric base.

According to another aspect of the present invention, an apparatus for monitoring and displaying exertion data may include a pressure sensor, a monitor device, and a display device. The pressure sensor includes detectors that measure a pressure change at the sensor and a transducer that provides a pressure signal corresponding to a magnitude of the detected pressure change. The monitor device includes a microprocessor that receives the pressure signal and provides a display signal to the display device based on the pressure signal and in accordance with a program instruction, and a program memory for storing the program instruction. The display device receives the display signal and provides a visual indication corresponding to the display signal. The pressure sensor, the monitor device, and the display device are attached to a fabric base. The fabric base is formed in the shape of a loop that is adapted to wrap around a hand, and wherein the fabric base includes an opening for receiving a thumb. The sensor is disposed on a region of the fabric base such that, when the fabric base is wrapped around a hand and a thumb of the hand is placed through the opening, the sensor is located proximate to the palm of the hand. The display device is disposed on a region of the fabric base such that, when the fabric base is wrapped around a hand and a thumb of the hand is placed through the opening, the display device is located on the back portion of the hand. The display device is preferably mounted on the monitor device, and the sensor is preferably disposed within the fabric base and is coupled to the monitor device by an electrically conductive wire that is disposed within the fabric base.

According to another aspect of the present invention, an apparatus for monitoring and displaying information related to pressure exerted at a point of interest during an isometric exercise includes a fabric base, adapted to receive a body part. A sensor is attached to the fabric base and disposed at the point of interest during the isometric exercise, and measures a pressure magnitude at the point of interest and provides a pressure signal corresponding to the pressure magnitude. A monitor, which receives the pressure signal, processes the pressure signal to derive information that is meaningful to a user, and generates a display signal corresponding to the information derived from the pressure signal. A display device, attached to the fabric base, receives the display signal and provides a visual indication of the information to the user. The fabric base includes an opening for receiving a thumb. The sensor is attached to the fabric base on a first side of the opening, and the display device is attached to the fabric base on a second side of the opening.

BRIEF DESCRIPTION OF THE DRAWING FIGURES

These and other objectives and advantages of the present invention will be apparent from the following detailed description, with reference to the drawings, in which.

DETAILED DESCRIPTION OF THE PRESENT INVENTION

Figure 1:
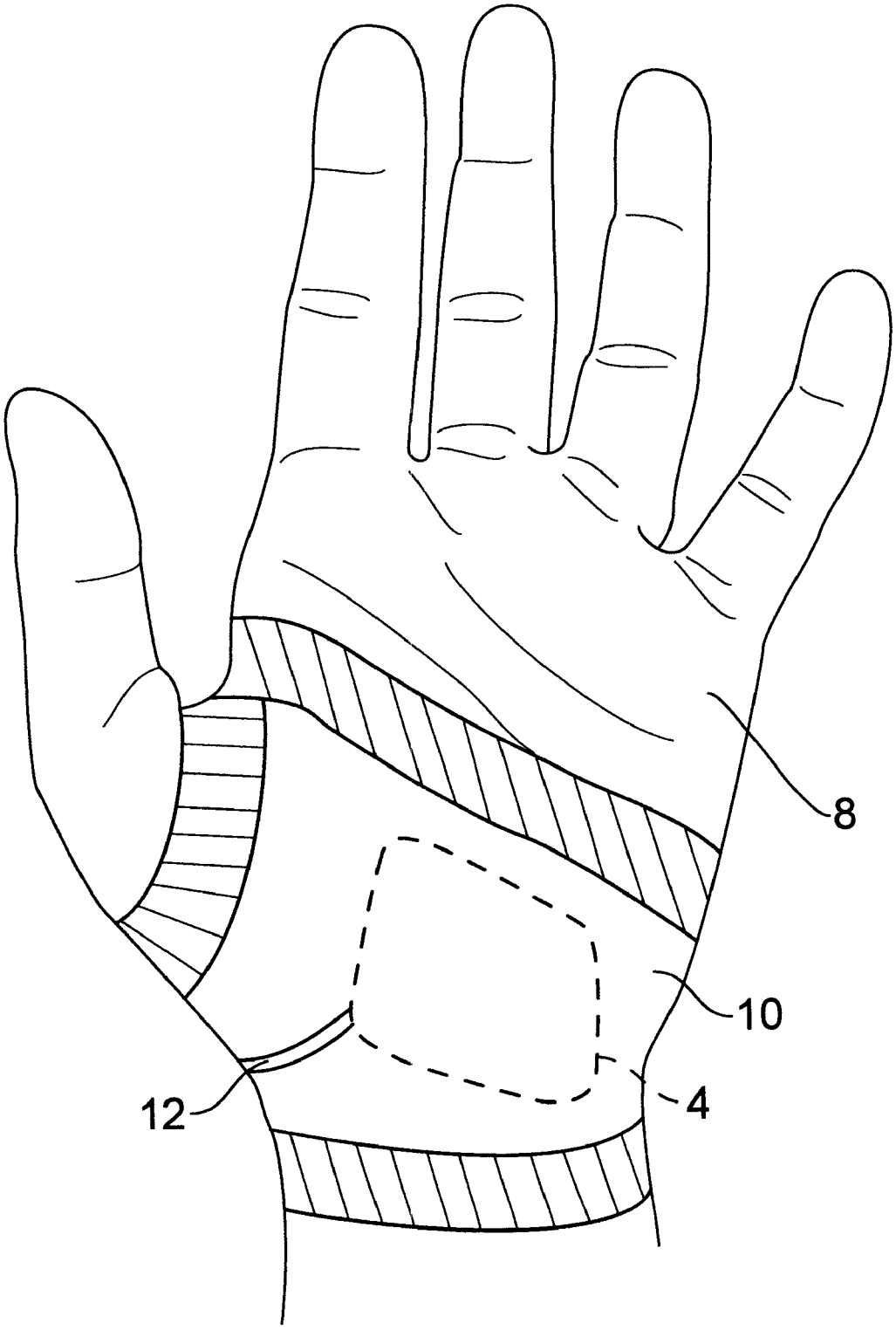
FIG. 1 shows sensors of an exemplary performance monitor of the present invention, attached to a user's hand.
Figure 2:
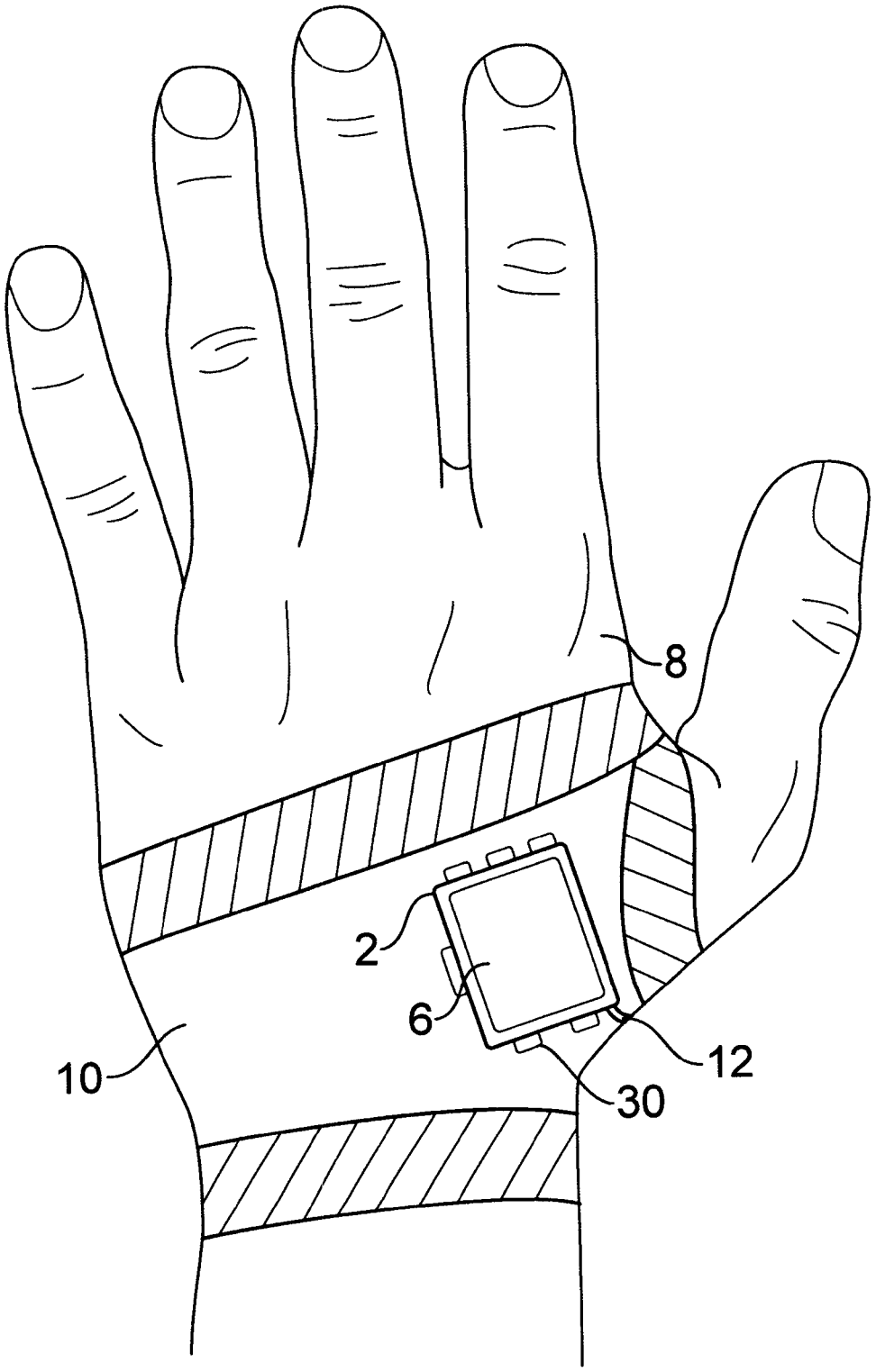
FIG. 2 shows an exemplary performance monitor and display of the present invention, worn on a user's wrist.
Figure 3:
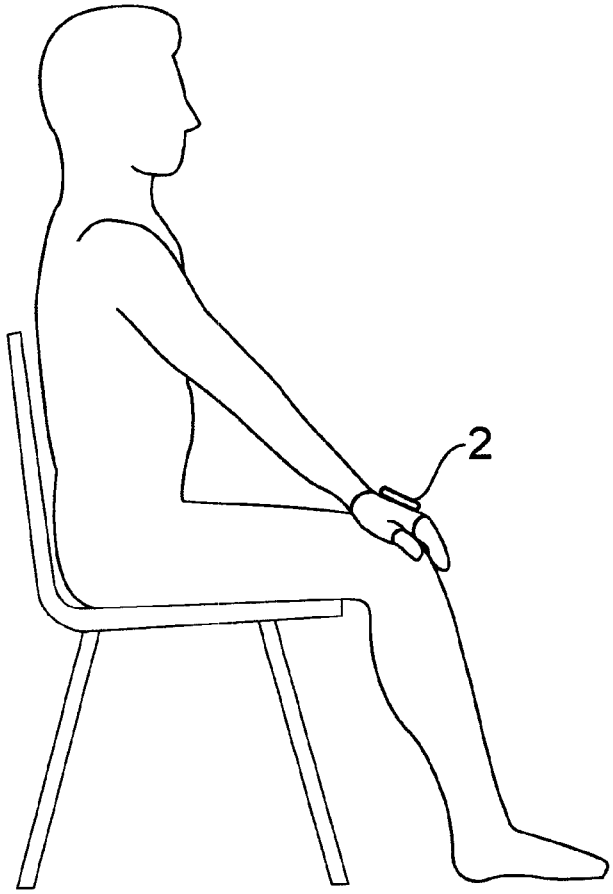
FIG. 3 shows a display of the present invention, showing performance results while the wearer performs an isometric exercise.

With reference to FIGS. 1 and 2, the device of the present invention includes three main components: a performance monitor 2, a sensor 4, and a display 6. The sensor 4 measures pressure, and attaches to the user's body at locations that will be under pressure during an isometric exercise. For example, an isometric exercise for the pectoral muscle group involves pressing the palms of the hands together at a distance in front of the person's chest. Because pressure is being exerted at the palms, that is where the sensor would be located. Alternatively, when an exercise is being performed that requires pressure to be applied against an object, the sensor may be placed on the object. For example, FIG. 3 shows an isometric exercise in which the person is pressing against his knees with both hands. It is preferable for sensors to be attached to the hands, for increased portability and convenience of the user. However, the sensors may be applied to the object instead.

As shown in FIG. 1, it is preferred that the sensor 4 be placed against the hand 8. According to a preferred embodiment of the invention, a full or partial glove 10 is worn by the user, and the sensor 4 is placed inside the glove 10, against the palm of the user's hand 8 or, preferably, is embedded or inserted within the fabric of the glove 10. The sensor 4 thus remains held in position against the hand 8 for convenience during the isometric exercise. The glove 10 may be made of any suitable material, such as nylon or leather, and may include a flexible elastic border or webbing to ensure a snug fit. Alternatively, the fit of the glove 10 may be adjustable through the use of Velcro® straps or other fasteners.

As shown in FIG. 2, the monitor 2 and display 6 are preferably constructed in a single housing, which is located on the glove 10 such that it is disposed on the back side of the user's hand 8. The monitor 2 and sensor 4 are connected by a line 12, which is preferably embedded in or sewn into the fabric of the glove 10.

The sensor 4 measures the pressure as an indication of the exertion applied by the person performing the exercise. The sensor 4 may be any known type of pressure sensor, which typically have transducers for converting the sensed pressure to electrical signals corresponding to the level of pressure sensed. It is preferable in the present invention that the sensor 4 is a digital pressure sensor that converts the sensed pressure to a digital signal, the magnitude of which corresponds to the magnitude of the sensed pressure. The sensor 4 is shown coupled to the monitor 2 by a line 12 that is an electrical wire, but these components may be coupled by some other link by which the pressure level signal is provided to the monitor 2.

Figure 4:
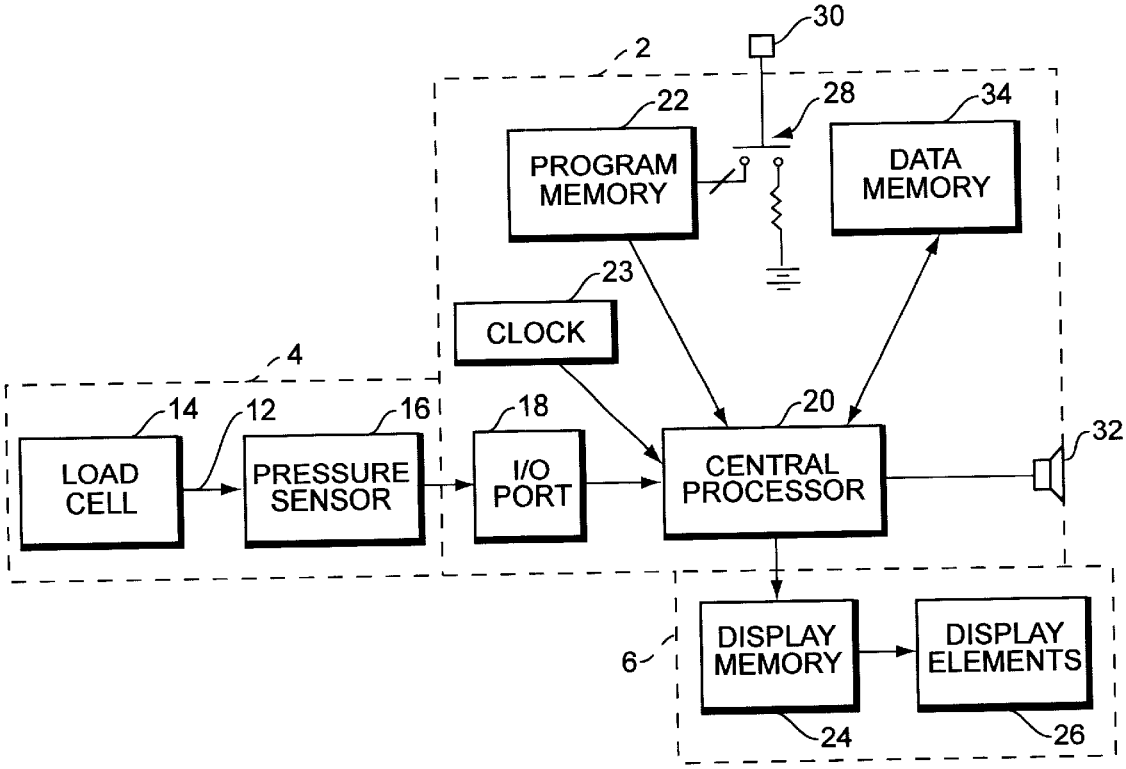
FIG. 4 shows a block diagram of a design for the performance monitor and display of the present invention.

The monitor 2 receives the pressure level signal, calculates the information desired by the user based on the signal, and displays the information to the user on the display 6. FIG. 4 shows a block diagram of an exemplary design for the sensor 4, the monitor 2, and display 6. The sensor 4 includes a load cell 14 or other transducer, for converting incident pressure to a voltage level. For example, a typical load cell 14 includes a piezoelectric crystal which, under pressure, generates a voltage level that is proportionate to the magnitude of the incident pressure. The voltage across the crystal is then provided to a pressure sensor 16, which is basically a buffer or converter for providing a pressure level signal based on the crystal voltage that is usable by the monitor 2.

The sensor 4 provides the pressure level signal to the monitor 2 on a line 12 that is preferably a bus having a width of n lines, where n is some number greater than 1. The size of n depends on the degree of granularity required in the pressure measurement, as well as the width of the input port 18 and the processing capability of the monitor 2. As shown, the monitor 2 receives the pressure level signal at the input port 18, where the signal is preferably buffered and provided to a microprocessor device. The microprocessor device, such as the central processor 20 shown in FIG. 4, processes the pressure level signal according to instructions stored in a program memory device 22, such as an EEPROM.

The microprocessor device 20 provides information as instructed to the display 6, which is coupled to the monitor 2, either within the same housing as the monitor 2 or in a remote and separate housing. The display 6 receives the information from the microprocessor device 20 and stores the information in a display memory 24. Stored information may be provided to display elements 26. Alternatively, the information may be provided directly to display drivers, which convert the information to signals that can be read by the display 6 and translated to the display elements 26. In this way, the information is displayed in some meaningful manner to the user. The display elements 26 are preferably LCD display elements, but may be any known display elements that can convert electrical signals to a visual indication that can be read by the user.

Through proper programming of the program memory device 22 with the instruction set for the microprocessor 20 and the display commands for the display device 6, the monitor 2 and display 6 may provide numerous functions and display many types of information. Preferably, the most basic function is the reading and display of the force exerted by the user in performing the current exercise. As previously described, this force corresponds to the pressure exerted at a particular point of contact, which pressure is measured by the sensor 4. Thus, the user has an immediate indication of his or her performance level for that exercise.

Another function may be the monitoring of the duration of the exercise, that is, the length of time that the user sustains pressure at the monitored point. This duration may be measured in terms of the cycle of a clock signal, which may be provided in the monitor by a clock driver circuit 23. It is a simple task for the microprocessor 20 to count the number of clock cycles that pass while a positive pressure is measured at the sensor 4, or while pressure above a certain threshold is detected. If the pressure is pulsed or otherwise periodically varied during the exercise, the monitor 2 can count repetitions as the pressure level passes above and below a predetermined threshold, and can display repetition information to the user. Based on the pressure profile provided by the peak pressure measurement, number of repetitions, and duration of repetitions, the amount of work performed during the exercise can also be calculated and displayed to the user.

The various exercise metrics can be provided to the user at strategic times during the exercise. For example, the peak pressure may be indicated when it is reached, the duration may be indicated at the end of a repetition, and the number of repetitions and amount of work performed can be indicated at the end of the exercise. Alternatively, this information may be displayed in series at the end of the exercise. As another alternative, the regular program of the microprocessor may be interrupted by the user when the user desires to have particular information displayed. This may be achieved, for example, through the use of one or more momentary switches 28 connected to address inputs of the program memory device 22. These switches 28 may be implemented as buttons 30 on the housing of the monitor. Numerous switches may be provided, each corresponding to a dedicated function stored as an instruction in the program memory device 22, which force the program memory device address to a command to the microprocessor 20 to provide the proper display information to the display 6. Alternatively, a single switch may be provided which sequences through a number of memory addresses when actuated, thereby sequencing through functions, which are displayed.

The previously-mentioned thresholds also may be set in the program memory 22 through the use of the switch 28. The thresholds can be used to count repetitions, and also can be set for a person's performance goals. For example, a person may set a peak threshold that must be reached before a repetition is counted. These thresholds may be provided in the program memory 22 at a number of different selectable levels, so that a person may step up to more difficult levels as she increases her strength on a particular exercise.

Likewise, indications may be set directly at the display 6 by the user. For example, the user may set a particular repetition duration for an exercise by actuating another switch that sequences through numbers shown on the display 6. Once set, this information may be provided to the microprocessor 20, which monitors the duration of the repetitions. When the set duration is achieved, a signal may be sent to an audio indicator 32 to alert the user that the desired duration has been achieved. This allows the user to track his repetition duration without directing his visual attention to the display device 6. Similar audible alerts can be given when a desired peak pressure is achieved, when a desired amount of work has been performed during an exercise, or when the user's selected peak level has been reached on a given repetition.

In addition to information regarding current exercise metrics, past exercise data may be displayed as well. For example, the value for a maximum pressure exerted by the user during a particular exercise may be stored in a data memory device 34. Thus, the user may check his previous best value, and strive to exceed it during the current exercise session. Even if the user does not check the previous high value prior to beginning the exercise, the monitor may provide a signal to indicate that the previous maximum has been matched or exceeded. This signal may be provided to the display 6, to the audio device 32, or to both.

As described, the present invention provides performance information to a person performing an isometric exercise. By offering a wide variety of information to the user, and flexibility on how the information is brought to the attention of the user, the person's motivation is maintained. The device of the present invention is extremely portable and may be used anywhere inconspicuously, consistent with an isometric exercise system itself. The monitor and display may be contained in a single housing that may be, for example, strapped to the user's wrist or clipped to the user's clothing. The sensors, examples of which are well-known to those of skill in the art, may be small and flexible, contributing to the small, light-weight nature of the present invention.

As noted, it is preferred that the display device uses LCD display elements. However, the display device may use other elements instead, such as LED elements for easier viewing under dark conditions, or even a CRT display, so that the progression of pressure exerted by the user over the course of a repetition may be observed.

Figure 5:
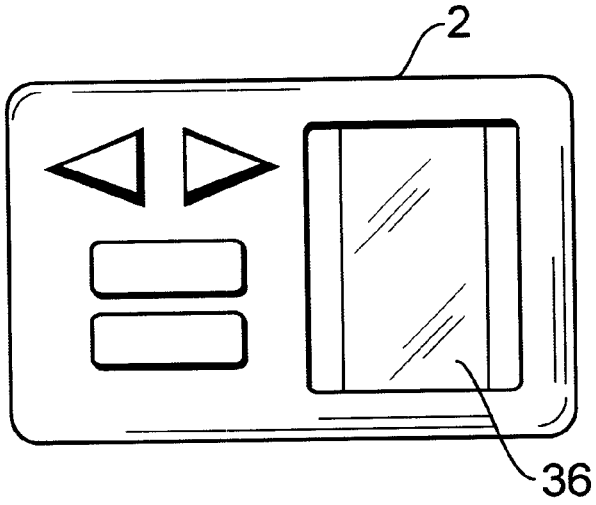
FIG. 5 shows an alternative display device of the present invention.

An alternative display 36 is shown in FIG. 5. Rather than using numerals to show the quantities representing the exercise metrics, the display graphically depicts the exertion by representing the pressure level as a bar that rises until a peak value is reached, or which incrementally grows as repetitions are achieved. Other modifications may be made to the precise manner in which data may be displayed to the user.

Further, the exemplary circuit of FIG. 4 may be modified according to fabrication considerations. For example, the program memory 22 and the data memory 34 may occupy separate parsed regions of the same memory device. Likewise, for convenience, the display memory 24 may be fabricated as part of the monitor 2, rather than as part of the display 6, or the monitor and display may be constructed together as a unit.

Further, the present invention has been described herein in a particular embodiment of an article to be worn around the hand. However, many isometric exercises do not result in pressure being applied to the hand, and therefore the fabric base on which the circuitry is fabricated may be attached to a more appropriate body part. For example, the fabric may take the form of a simple loop, which may be wrapped around a limb and fastened such that it is held in place and so that the sensor is disposed properly. In this way, for example, the calf muscles may be exercised by sitting at a desk with the feet placed on a platform so that the fronts of the thighs are touching the underside of the desktop. By pushing up against the desk with the thighs by attempting to raise the heels off the ground, the calf muscles will be stressed. Because the pressure from the exertion is best measured at the interface between the thighs and the desk, the fabric can be wrapped around the thighs, with the sensors placed between the thighs and the desk. The flexibility provided by the fabric loop allows for placement anywhere on the body, allowing for measurement of performance data of any isometric exercise.

Thus, the particular fabric article, the disclosed circuit, and other depictions of the present invention provided herein are not limiting of the present invention, but rather are preferred embodiments of the present invention as currently contemplated by the inventor, and may be modified within the spirit and scope of the present invention.

Preferred and alternative have been described in detail. It must be understood, however, that the invention is not limited to the particular embodiments described herein. Rather, the invention is defined by the following claims, which should be given the broadest interpretation possible in light of the written description and the relevant prior art.

What is claimed is:

1. An apparatus for monitoring and displaying exertion data, comprising:

a sensor that directly measures incident pressure at an interface between the sensor and an external object and provides a pressure signal corresponding to a magnitude of the incident pressure;

a monitor device that receives the pressure signal, processes the pressure signal according to processing instructions, and generates a display signal corresponding to the pressure signal; and a display device that receives the display signal and provides visual information corresponding to the display signal.

2. The apparatus of claim 1, wherein the sensor includes a transducer against which the incident pressure is applied and which generates a voltage level proportionate to a magnitude of the incident pressure; and a converter that receives the voltage level and converts the voltage level to the pressure signal.

3. The apparatus of claim 2, wherein the pressure signal is a digital signal.

4. The apparatus of claim 1, wherein the monitor device includes a processor that receives the pressure signal, processes the pressure signal, and generates the display signal; and program memory, in which the processing instructions are stored and which provides the processing instructions to the processor to control processing of the pressure signal.

5. The apparatus of claim 1, further comprising a signal bus, on which the pressure signal is provided from the sensor to the monitor device.

6. The apparatus of claim 1, wherein the monitor device includes a processor that receives the pressure signal, processes the pressure signal, and generates pressure data and the display signal; and program memory, in which the processing instructions are stored and which provides the processing instructions to the processor to control processing of the pressure signal.

7. The apparatus of claim 6, wherein the monitor device further includes data memory, for storing the pressure data.

8. The apparatus of claim 6, wherein the pressure data includes data corresponding to an instantaneous pressure change at the sensor.

9. The apparatus of claim 6, wherein the monitor further includes a clock generator for providing a periodic output signal, and wherein the pressure data includes data corresponding to a duration of incident pressure at the sensor, measured by the output signal of the clock generator.

10. The apparatus of claim 6, wherein the monitor further includes a clock generator for providing a periodic output signal, and wherein the pressure data includes data corresponding to a duration that incident pressure at the sensor is maintained above a threshold pressure, measured by the output signal of the clock generator.

11. The apparatus of claim 6, wherein the pressure data includes data corresponding to a number of repetitions that incident pressure at the sensor crosses a threshold pressure in a positive direction.

12. The apparatus of claim 6, wherein the pressure data includes data corresponding to a peak pressure incident at the sensor.

13. The apparatus of claim 6, wherein the monitor device further includes an audio output device, which provides an audible signal on actuation by the processor under the control of the processing instructions, when predetermined pressure data is generated.

14. The apparatus of claim 7, wherein the pressure data includes a comparison result of first pressure data corresponding to a current pressure signal and second pressure data stored in the data memory; and wherein the monitor device further includes an audio output device, which provides an audible signal on actuation by the processor under the control of the processing instructions, when the pressure data includes a predetermined comparison result.

15. The apparatus of claim 6, wherein the monitor device further comprises a switch which, when actuated, changes the processing instructions.

16. The apparatus of claim 15, wherein the switch is coupled to an address input of the program memory.

17. The apparatus of claim 16, wherein actuation of the switch changes a program address of the program memory to a set value, causing interruption of processing of the pressure signal.

18. The apparatus of claim 16, wherein actuation of the switch changes a program address of the program memory to a set value, causing a change in the display signal.

19. The apparatus of claim 1, wherein the display device includes display elements to provide a visual indication of the display signal.

20. The apparatus of claim 1, further including a fabric base, wherein the sensor, the monitor device, and the display device are attached to the fabric base.

21. The apparatus of claim 20, wherein the fabric base is formed in the shape of a glove that is adapted to receive a hand.

22. The apparatus of claim 20, wherein the fabric base is formed in the shape of a loop that is adapted to wrap around a body part.

23. The apparatus of claim 22, further including a fastener to secure the fabric base when the fabric base is wrapped around the body part.

24. The apparatus of claim 22, wherein the fabric base includes an opening for receiving a thumb.

25. The apparatus of claim 24, wherein the fabric base includes an elastic periphery adapted to provide a spring force such that the fabric base can grip a user's hand.

26. The apparatus of claim 22, wherein the sensor is disposed on a region of the fabric base such that, when the fabric base is wrapped around a hand, the sensor is located proximate to the palm of the hand.

27. The apparatus of claim 24, wherein the sensor is disposed on a region of the fabric base such that, when the fabric base is wrapped around a hand and a thumb of the hand is placed through the opening, the sensor is located proximate to the palm of the hand.

28. The apparatus of claim 22, wherein the display device is disposed on a region of the fabric base such that, when the fabric base is wrapped around a hand, the display device is located on the back portion of the hand.

29. The apparatus of claim 24, wherein the display device is disposed on a region of the fabric base such that, when the fabric base is wrapped around a hand and a thumb of the hand is placed through the opening, the display device is located on the back portion of the hand.

30. The apparatus of claim 21, wherein the display device is mounted on the monitor device.

31. The apparatus of claim 21, wherein the sensor is disposed within the fabric base.

32. The apparatus of claim 21, wherein the sensor is coupled to the monitor device by an electrically conductive wire.

33. The apparatus of claim 32, wherein the wire is disposed within the fabric base.

34. An apparatus for monitoring and displaying exertion data, comprising:

a pressure sensor;

a monitor device; and a display device;

wherein the pressure sensor includes at least one detector that directly measures a change in pressure applied at an interface between an external object and the sensor, and a transducer that provides a pressure signal corresponding to a magnitude of the detected change in pressure applied at the sensor;

wherein the monitor device includes a microprocessor that receives the pressure signal and provides a display signal to the display device based on the pressure signal and in accordance with a program instruction, and a program memory for storing the program instruction; and wherein the display device receives the display signal and provides a visual indication corresponding to the display signal.

35. The apparatus of claim 34, further including a fabric base, wherein the pressure sensor, the monitor device, and the display device are attached to the fabric base.

36. The apparatus of claim 35, wherein the fabric base is formed in the shape of a loop that is adapted to wrap around a hand, and wherein the fabric base includes an opening for receiving a thumb.

37. The apparatus of claim 36, wherein the sensor is disposed on a region of the fabric base such that, when the fabric base is wrapped around a hand and a thumb of the hand is placed through the opening, the sensor is located proximate to the palm of the hand; and the display device is disposed on a region of the fabric base such that, when the fabric base is wrapped around a hand and a thumb of the hand is placed through the opening, the display device is located on the back portion of the hand.

38. The apparatus of claim 37, wherein the display device is mounted on the monitor device.

39. The apparatus of claim 34, wherein the sensor is disposed within the fabric base.

40. The apparatus of claim 34, wherein the sensor is coupled to the monitor device by an electrically conductive wire that is disposed within the fabric base.

41. An apparatus for monitoring and displaying information related to pressure exerted at a point of interest during an isometric exercise, comprising:

a fabric base, adapted to receive a body part;

a sensor attached to the fabric base and disposed at the point of interest during the isometric exercise, wherein the sensor measures a pressure magnitude at the point of interest and provides a pressure signal corresponding to the pressure magnitude;

a monitor, which receives the pressure signal, processes the pressure signal to derive information that is meaningful to a user, and generates a display signal corresponding to the information derived from the pressure signal; and a display device, attached to the fabric base, that receives the display signal and provides a visual indication of the information to the user.

42. The apparatus of claim 41, wherein the fabric base includes an opening for receiving a thumb, wherein the sensor is attached to the fabric base on a first side of the opening, and the display device is attached to the fabric base on a second side of the opening.

* * * * *